United States Patent [19]

Wittlin

[11] Patent Number: 4,570,209

[45] Date of Patent: Feb. 11, 1986

[54] INDOOR LIGHTING ARRANGEMENT EMPLOYING HIGH INTENSITY DISCHARGE LIGHT SOURCES

[75] Inventor: Seymour I. Wittlin, Roslyn, N.Y.

[73] Assignee: Sentry Electric Corp., Freeport, N.Y.

[21] Appl. No.: 637,647

[22] Filed: Aug. 3, 1984

[51] Int. Cl.[4] ..... F21V 9/00

[52] U.S. Cl. ..... 362/231; 362/1

[58] Field of Search ..... 362/1, 2, 230, 231

[56] References Cited

U.S. PATENT DOCUMENTS

| | | | |
|---|---|---|---|
| 1,957,404 | 5/1934 | Beck | 362/231 |
| 2,725,461 | 11/1955 | Amour | 362/231 |
| 2,831,966 | 4/1958 | Porteous | 362/231 |
| 3,093,319 | 6/1963 | Gamain | 362/231 |
| 3,201,576 | 8/1965 | Scott et al. | 362/1 |
| 4,091,441 | 5/1978 | Ott | 362/231 |
| 4,120,026 | 10/1978 | Tsuchihashi et al. | 362/1 |

*Primary Examiner*—Ira S. Lazarus

*Attorney, Agent, or Firm*—Alan H. Levine

[57] ABSTRACT

An indoor lighting arrangement employing a combination of high pressure sodium (HPS) light sources, which produce a yellowish light, and mercury vapor or metal halide light sources, which produce a whiter light. Where the distance between the floor and the plane containing the light sources is at least fifteen feet, the HPS and whiter light sources are mounted in a checkerboard pattern so that the yellow and white illumination which they produce is completely mixed at normal eye level. When lower ceiling heights are involved, lighting fixtures are used which each contain both an HPS lamp and a whiter light lamp.

7 Claims, 3 Drawing Figures

INDOOR LIGHTING ARRANGEMENT EMPLOYING HIGH INTENSITY DISCHARGE LIGHT SOURCES

This invention relates to indoor lighting of large areas, such as are found in gymnasiums, stores, factories, and warehouses.

Such areas are commonly illuminated by incandescent or fluorescent lighting. While the illumination produced by such lighting is entirely satisfactory, these installations consume large amounts of electrical energy and hence are expensive to operate. For this reason, attention has been directed to indoor use of high intensity discharge (HID) lighting used extensively to illuminate streets and highways.

HID light sources include high pressure sodium (HPS), mercury vapor (MV) and metal halide (MH). From the point of view of economy of operation, HPS is preferable since it requires the least power to provide equivalent intensity of illumination. A drawback of HPS is that it produces a yellowish light which many users consider unacceptable. For this reason, MV or MH are selected, since they produce a whiter light comparable to fluorescent cool white light, even though these systems cost more to operate.

It is an object of the present invention to provide an indoor lighting arrangement, utilizing HID light sources, which maximizes the balance between economy of operation and production of lighting having an acceptable color characteristic.

This objective of the invention can be achieved by providing an indoor lighting arrangement wherein individual HPS and whiter light sources (MV or MH) are located in a checkerboard pattern to provide a satisfactory color mixture of light. In this way, economy of operation offered by the HPS lighting is obtained but its yellowish light is tempered toward an acceptable whiteness.

The invention can also be carried out by locating an HPS lamp and a MV or MH lamp in the same lighting fixture, so that the mixture of light emanates from each such fixture.

Additional objects and features of the invention will be apparent from the following description in which reference is made to the accompanying drawings. In the drawings.

Figure 1:
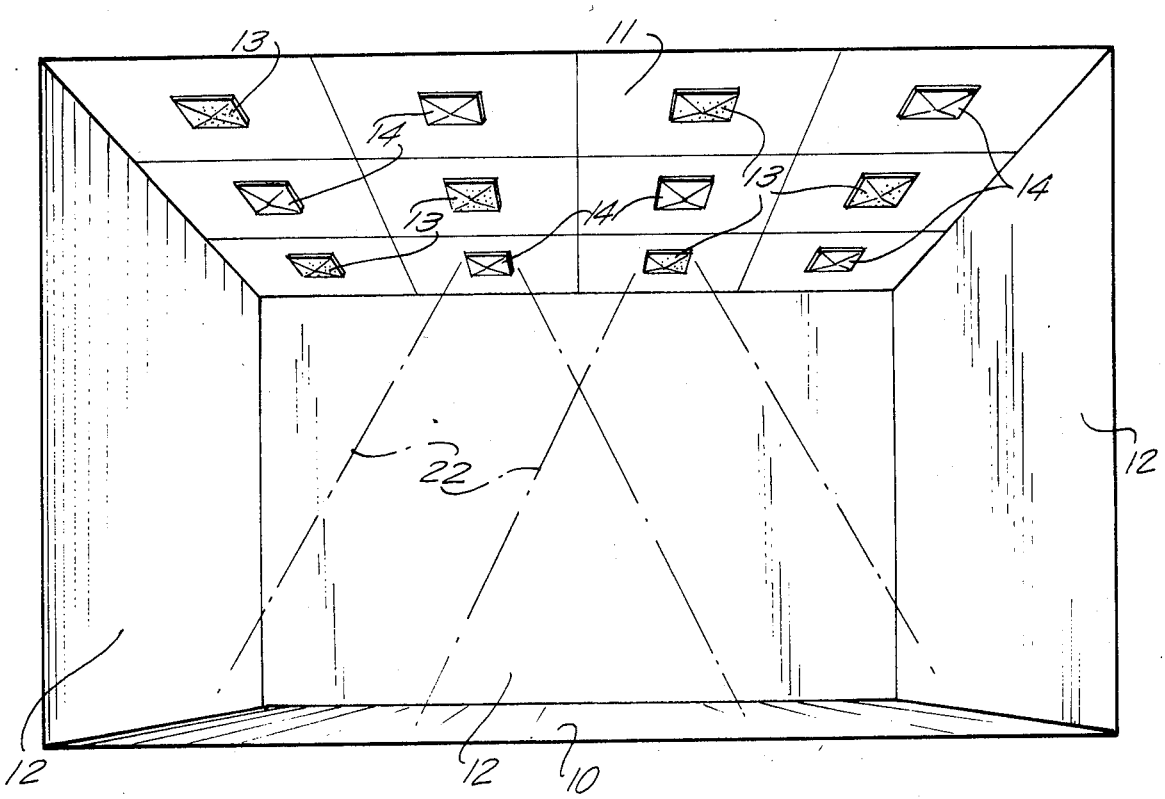
FIG. 1 is a perspective view of an indoor space being illuminated by an arrangement according to the present invention.
Figure 2:
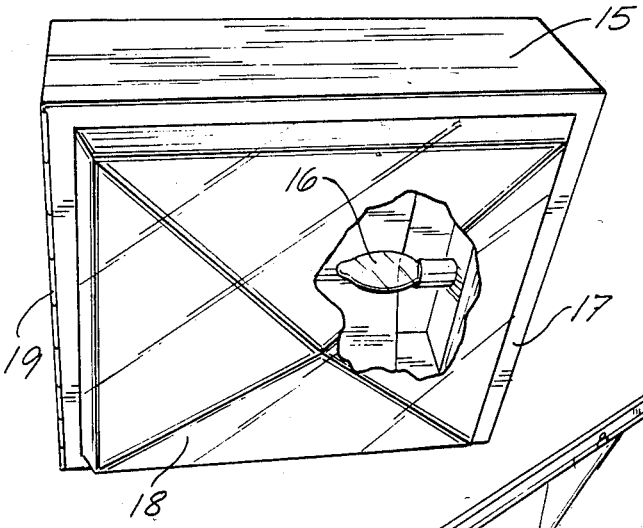
FIG. 2 is a perspective view of a lighting fixture, partially broken away, containing a HID lamp.

An indoor lighting arrangement chosen to illustrate the present invention is shown in FIG. 1. An indoor space to be illuminated includes a floor 10, a ceiling 11, and walls 12. Mounted on ceiling 11, in a rectangular grid-like pattern, is an array of lighting fixtures 13 and 14. Each of the lighting fixtures includes a housing 15 (FIG. 2) containing a HID light source 16 and a cover 17 for the housing. The cover, which is hinged to housing 15 at 19 carries a plastic translucent diffuser 18.

The light source contained in each fixture 13 is a high pressure sodium (HPS) lamp, and the light source contained in each fixture 14 is either a mercury vapor (MV) lamp or a metal halide (MH) lamp. It will be seen that fixtures 13 and 14 alternate along each line of the grid pattern, i.e., each horizontal line in FIG. 1, and each generally vertical line, which represents the direction perpendicular to the drawing sheet. Thus, the HPS and MV or MH light sources are arranged in a checkerboard pattern. The light emanating from each fixture spreads in a downward direction, as indicated by the dot-dash lines 22, and hence mixes completely with the light from adjacent fixtures by the time the light reaches floor 10. In fact, if the distance between floor 10 and ceiling 11 is at least fifteen feet, the light is completely mixed and yields an acceptable color characteristic by the time it reaches a level of about ten feet above floor 10. Thus, the arrangement illustrated in FIG. 1 should only be used where the ceiling height is at least fifteen feet. In a case where the lighting fixtures are suspended from the ceiling, the arrangement shown should be used only where the distance between the floor 10 and plane containing the lighting fixtures is at least fifteen feet.

The higher the wattage of MV or MH lamps used, the whiter will be the mixture of light, and the more expensive the system will be to operate. However, it has been found that a satisfactory color mixture is achieved if the ratio of HPS wattage to whiter light wattage is between 90 to 10 and 60 to 40.

In spaces having ceiling heights less than fifteen feet, it has been found that the checkerboard arrangement of HPS and whiter HID lamps does not give entirely satisfactory results, because there is not a sufficient vertical distance for the different colored light to mix, and zones of yellowish and whiter light are perceptible. For these situations, lighting fixtures having two sources of illumination should be used.

Figure 3:
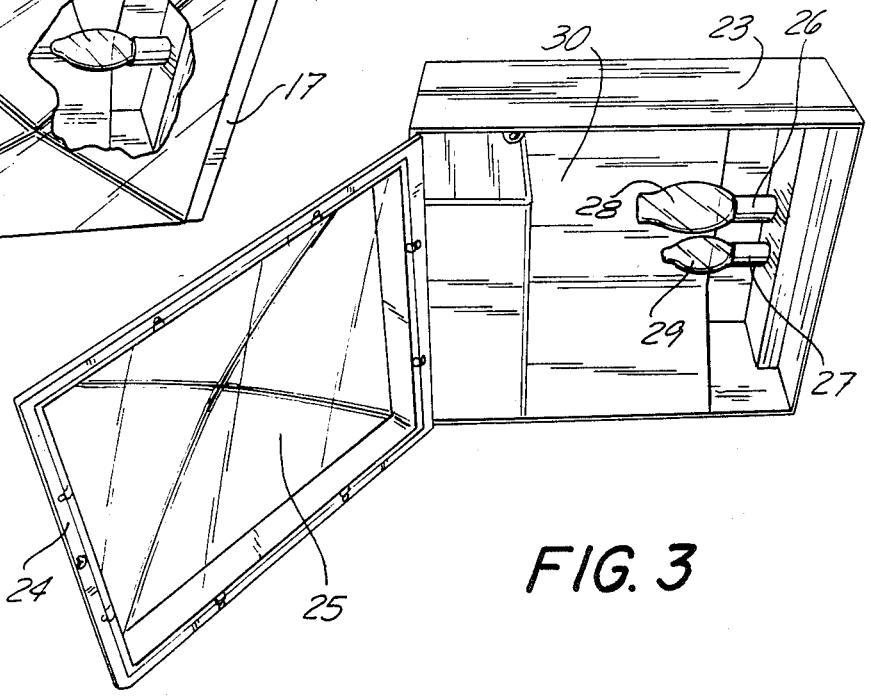
FIG. 3 is a perspective view of a lighting fixture containing two HID lamps.

FIG. 3 shows a lighting fixture including a housing 23, and a cover 24 hinged to the housing carrying a diffuser 25. Within the housing are two sockets 26 and 27 accommodating the bases of two lamps 28 and 29, respectively. Lamp 28 is a HPS lamp, and lamp 29 is a MV lamp. Lamp 29 could be a MH lamp, if desired. Behind, i.e., above, the lamps 28 and 29 is a reflector 30. Locating both a HPS and a whiter HID lamp in a single fixture provides a mixture of light emanating from the figure which is acceptable in color. Although in FIG. 3 the lamps 28 and 29 are shown side-by-side, they could be one above the other or end-to-end as well.

The higher the wattage of MV or MH lamp used, the whiter will be the mixture of light emanating from the fixture of FIG. 3, and the more expensive the fixture will be to operate. However, it has been found that a satisfactory color mixture is achieved if the ratio of HPS wattage to whiter light wattage is between 90 to 10 and 60 to 40.

It will be appreciated that the present invention offers an indoor lighting arrangement whereby HPS light sources are used to provide relatively low cost operation for the intensity of illumination yielded, and wherein the yellowness of the HPS light is masked by combining it with whiter MV or MH light. This light mixture is as acceptable as pure MV or MH light, but is created at a greatly reduced cost of operation.

This invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

1. An indoor lighting arrangement consisting essentially of high intensity discharge light sources, comprising:

at least one high pressure sodium light source which produces a yellowish light, at least one whiter light source selected from the group consisting of mercury vapor and metal halide, and means for supporting said light sources in a plane spaced above and generally parallel to the floor of the indoor space being illuminated, the light sources being oriented to direct the light which they emit toward the floor of the indoor space, and said means also supporting said light sources with respect to each other so that the yellow and white illumination which they produce is completely mixed at normal eye level within the indoor space being illuminated.

2. An indoor lighting arrangement as defined in claim 1 including several high pressure sodium light sources and several whiter light sources, all the light sources being arranged in a rectangular grid pattern, and the high pressure sodium and whiter light sources alternating along each line of the grid.

3. An indoor lighting arrangement as defined in claim 2 wherein the wattage of each high pressure sodium light source and the wattage of each whiter light source are in a ratio of between 90 to 10 and 60 to 40.

4. An indoor lighting arrangement as defined in claim 2 including a separate electrical fixture enclosure for each light source.

5. An indoor lighting arrangement as defined in claim 2 wherein the distance between the floor of the indoor space being illuminated and the plane containing the light sources is a minimum of fifteen feet.

6. An indoor lighting arrangement as defined in claim 1 including at least one electrical fixture enclosure, one high pressure sodium light source and one whiter light source being located within the same enclosure.

7. An indoor lighting arrangement as defined in claim 6 wherein the wattage of the high pressure sodium light source and the wattage of the whiter light source are in a ratio of between 90 to 10 and 60 to 40.

* * * * *